United States Patent [19]

Selva

[11] Patent Number: 4,848,685

[45] Date of Patent: Jul. 18, 1989

[54] AUTOMATIC APPARATUS FOR SHAPING WINDINGS FOR COILS PARTICULARLY SUITABLE TO DIPOLE OR QUADRUPOLE MAGNETS

[75] Inventor: Luciano Selva, Milan, Italy

[73] Assignee: Ezio Selva, S.r.l., Milan, Italy

[21] Appl. No.: 151,936

[22] Filed: Feb. 3, 1988

[30] Foreign Application Priority Data

Feb. 9, 1987 [IT] Italy ..... 19302 A/87

[51] Int. Cl.[4] ..... B21F 3/10; H01F 41/06

[52] U.S. Cl. ..... 242/7.15; 29/599; 29/605; 140/92.1

[58] Field of Search ..... 242/1, 7.01, 7.06, 7.07, 242/7.14, 7.15, 7.16; 29/599, 605; 72/144; 140/92.1

[56] References Cited

U.S. PATENT DOCUMENTS

| | | | |
|---|---|---|---|
| 2,964,252 | 12/1960 | Rosenberg | 242/7.15 |
| 4,271,585 | 6/1981 | Satti | 29/599 |
| 4,554,731 | 11/1985 | Borden | 29/605 |

FOREIGN PATENT DOCUMENTS

| | | | |
|---|---|---|---|
| 909003 | 4/1954 | Fed. Rep. of Germany | 29/605 |
| 1009509 | 5/1952 | France | 140/92.1 |
| 577586 | 10/1977 | U.S.S.R. | 29/605 |
| 1106333 | 7/1985 | U.S.S.R. | 29/599 |

*Primary Examiner*—Joseph J. Hail, III

*Attorney, Agent, or Firm*—Edward S. Irons

[57] ABSTRACT

An apparatus is described for substantially automatically shaping the windings of coils in which the conductor is mainly directed longitudinally, parallel to the coil axis, with ends having different radius size, in any case relatively narrow, as it happens e.g. in the dipole or quadrupole magnets. The apparatus comprises a stationary bed to which a support bar for supporting a winding holder and form is mounted for an alternate rotation of about 180°. Along a side of this bed and parallel to the support bar a carriage can run with a reciprocating motion, having a cantilevered bracket for mounting an arm rotatable around a vertical axis to support a supply reel of a superconductor to be wound onto the coil. The three movements are mutually interpolated and programmable by a CPU, at each side of the winding holder there being further provided a multiplicity of ram elements to push the last unwound length of superconductor to the correct position, every time at opposed sides, and to keep the previously formed turns at such a position, in cooperation with matching curve members. Intermediate tiltable supports are also provided, to follow the support bar movement of rotation without tempering with the superconductor laying and fitting, respectively at either side of the winding holder, as well as end pressing devices.

12 Claims, 7 Drawing Sheets

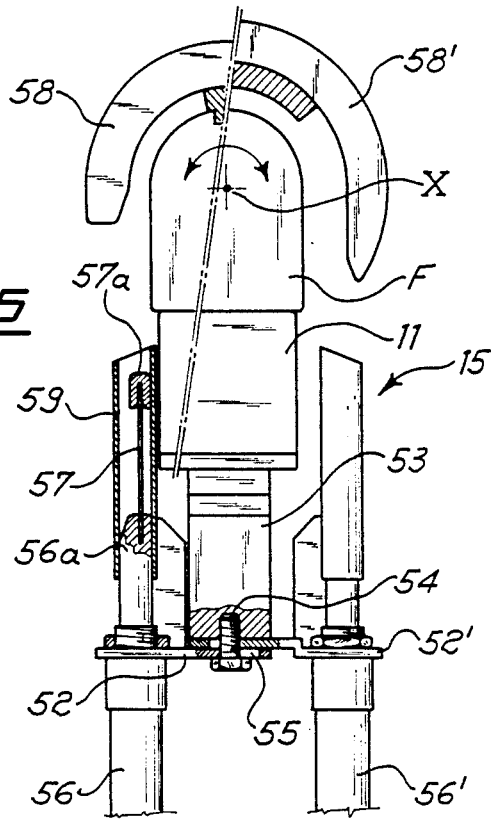
Fig. 5
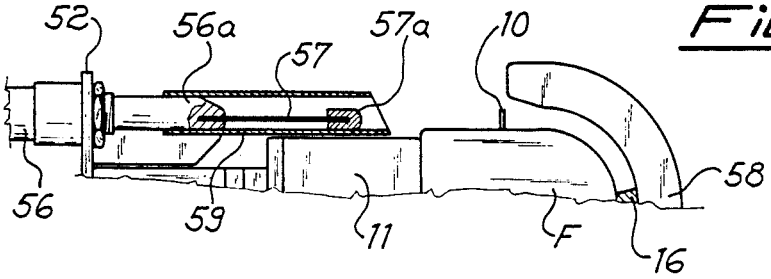
Fig. 5a
Fig. 5b
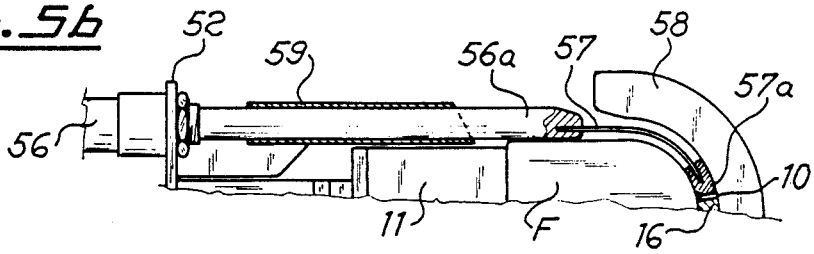

Fig. 6
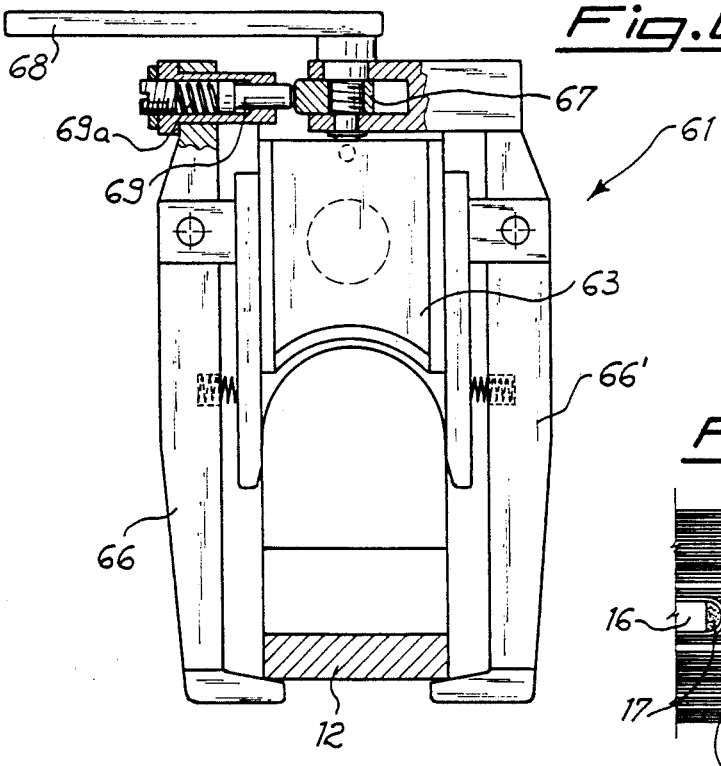
Fig. 6b
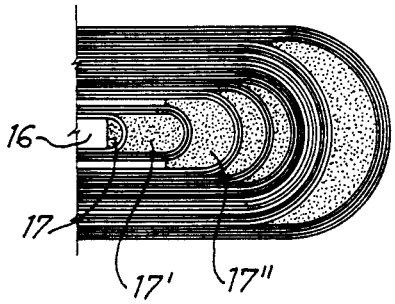
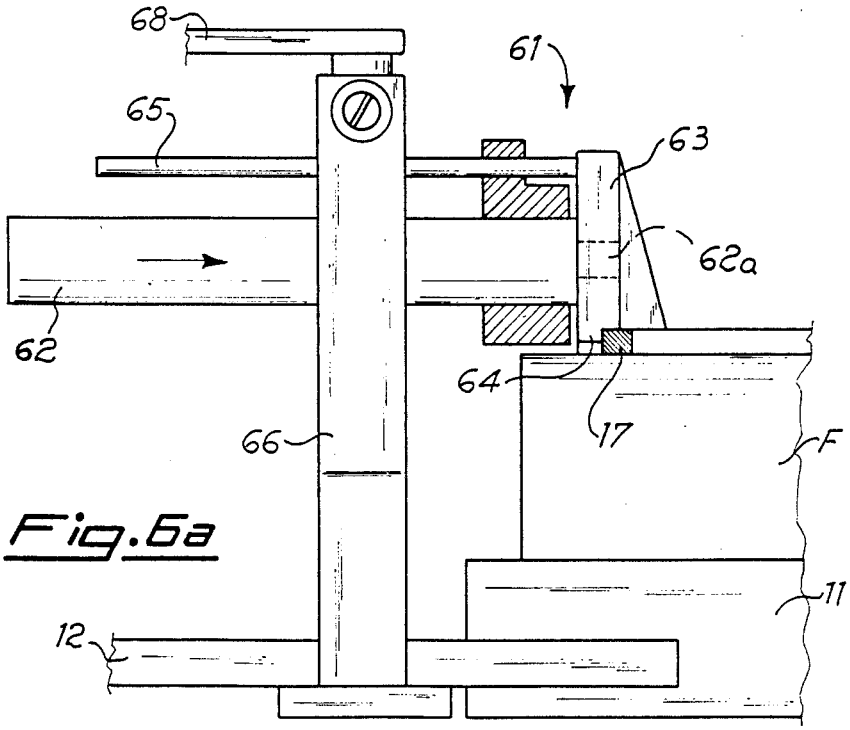
Fig. 6a

IX
94
92a
92
75
23
71
IX
77
R
76
76a
78
74'
72
79'
22
77a
74
78
79
VIII
72a
73a
73
VIII
Z
10
4

AUTOMATIC APPARATUS FOR SHAPING WINDINGS FOR COILS PARTICULARLY SUITABLE TO DIPOLE OR QUADRUPOLE MAGNETS

BACKGROUND OF THE INVENTION

The present invention relates to an automatic apparatus for shaping windings into coils formed of turns having two opposite sides extending in a substantially longitudinal direction, parallel each other and to the coil axis, being connected by end portions with a varying, relatively narrow radius. These coils are particularly suitable to dipole or quadrupole magnets in which windings are formed of a ribbon-like superconductor cable with a substantially trapezoidal cross-section and a number of critical conditions are to be observed during their preparation, which however can be let out of mention here in view of the present invention.

The following description will refer to the manufacture of magnetic dipoles, and in particular to the processing steps when the superconductor is being wound, with a path of each turn as above indicated, on a semitoroidal metallic holder, substantially symmetrically to the median plane of the holder itself. The longitudinal sides of said turns are tightly close to one another and only upon completion of the winding such a position is permanently held by heating and consequent polimerization of a fiberglass-reinforced resin, laid onto the superconductor, thus forming the semicylindrical shell of a dipole in which the winding is embedded.

During the formation of the coil, to keep the closeness of the winding turns already laid at the central zone of the holder, while the winding extends towards the periphery with wider turns, it is necessary to make use of temporary fastening devices which consequently require a continuous manual intervention for the application and removal thereof.

As an attempt to reduce the requirements of time and of considerable labour costs due to an exclusively manual construction of these coils, a semi-automatic machine has been designed, substantially comprising a central structure on which the winding holder or support is rotatably mounted, with a carriage able to run about the same structure, being provided with a motion obtained through the engagement of a pinion mounted on the carriage with a stationary chain encircling said central structure. However it was found that with such a machine of known type the coil shape cannot be varied, especially as to the turn length, and if the winding rotation has to be reversed it would be necessary to make an intervention onto all the gearwheels mounted onto the carriage carrying the superconductor feed spool or drum. Furthermore the problem of keeping the previously formed turns at their position was not solved, as the fastening thereof had still to be provided manually with a considerable waste of labour and time. Finally the movements of unwinding the cable from the feeding reel and arranging the same onto the holder were without co-ordination and not correctly interpolated each other, thus causing some difficulties in obtaining correct intersecting planes between moving surfaces, especially while the winding layers are varying.

SUMMARY OF THE INVENTION

Therefore it is the object of the present invention to provide an automatic apparatus for the formation of coils of the above-mentioned type, with which winding is carried out without the inconveniences listed above, as it can be easily adapted to any size, in particular reduced the length of the coil to be formed, and also having a completely automatic operation wherein the movements are mutually interpolated and automatically corrected, while the superconductor is kept restrained during its forward movement in the longitudinal direction of the coil, with the positions of the formed turns being locked, thus greatly reducing the manufacturing time.

The various operations of the apparatus can be controlled, so that corrective actions may be provided, by a flexible programmed through a CPU control system which however is not a part of this invention.

According to a particular feature of the invention a device is also provided for a correct rewinding of the cable around the reel, both during rotation at the coil ends and in case of formation of a new winding.

The apparatus is basically comprised of a stationary structure which bears for an alternate rotation about its longitudinal axis the winding support holder, and a slidable carriage with a reciprocating motion at a side of the structure, parallel to said rotation axis, said carriage having mounted thereon, for rotating about an axis perpendicular to the rotation axis of the holder, a rotating arm carrying a superconductor cable feeding drum, constantly under a predeterminable value of pull in a direction opposite to the unwinding direction, the cable leaving said feed reel being able to reach symmetrical positions at either side of said holder upon a 180° rotation of said arm at the end of each longitudinal path of the carriage and before its reversal, there being also provided auxiliary support means for supporting the holder apart from at its ends and a multiplicity of pressure means at both sides of the holder to tangentially keep motionless the laid cable lengths, in cooperation with U-shaped checking forms applied onto the holder, against a longitudinal central stop or block provided on the latter.

According to a particular embodiment of the invention a pressure means is also provided, with an axially directed action at each end of the coil for a correct positioning of the cable at the ends themselves.

BRIEF DESCRIPTION OF THE DRAWINGS

These and other objects, advantages and features of the apparatus of the present invention will be clear to those skilled in the art from the following detailed description of a preferred embodiment thereof, given by way of a non-limiting example with reference to the drawings in which:

FIG. 5 shows a cross-section view along line V—V of FIG. 2, wherein the left-hand portion relates to a first layer of winding and the right-hand portion to a second layer;

FIGS. 5*a* and 5*b* show in two successive steps the operation of one of the rams represented at FIG. 5 during the insertion of a cable length, with winding turns already formed;

FIGS. 6 and 6*a* show two schematic side views, respectively at right angles, of a pressure device for a coil end and FIG 6*b* a plan view of a coil end portion nearly completed;

DETAILED DESCRIPTION OF THE PREFERRED EMBODIMENTS

Figure 1:
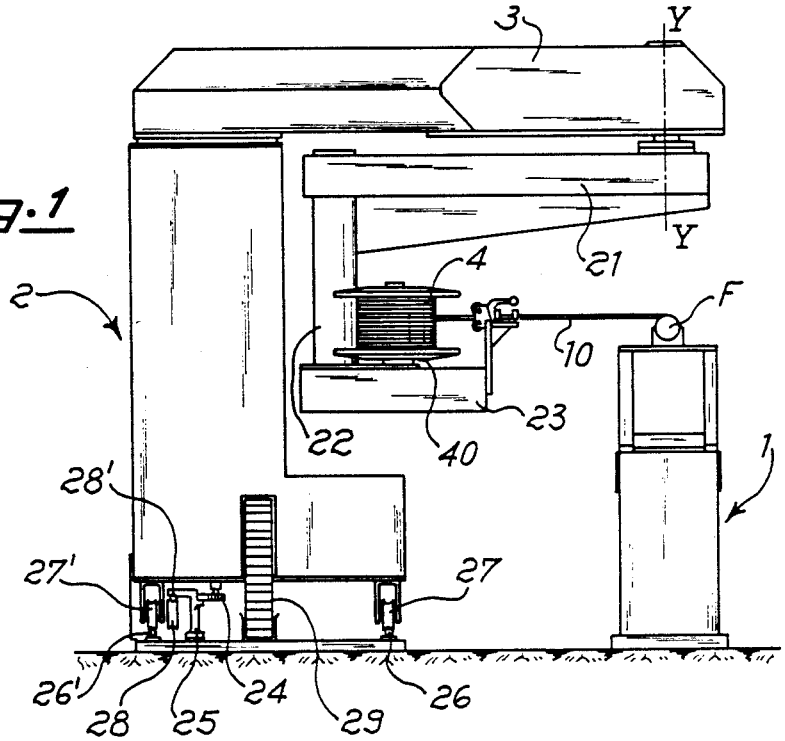
FIG. 1 shows a schematic front view of the apparatus, i.e. taken along the running direction of the carriage.
Figure 2:
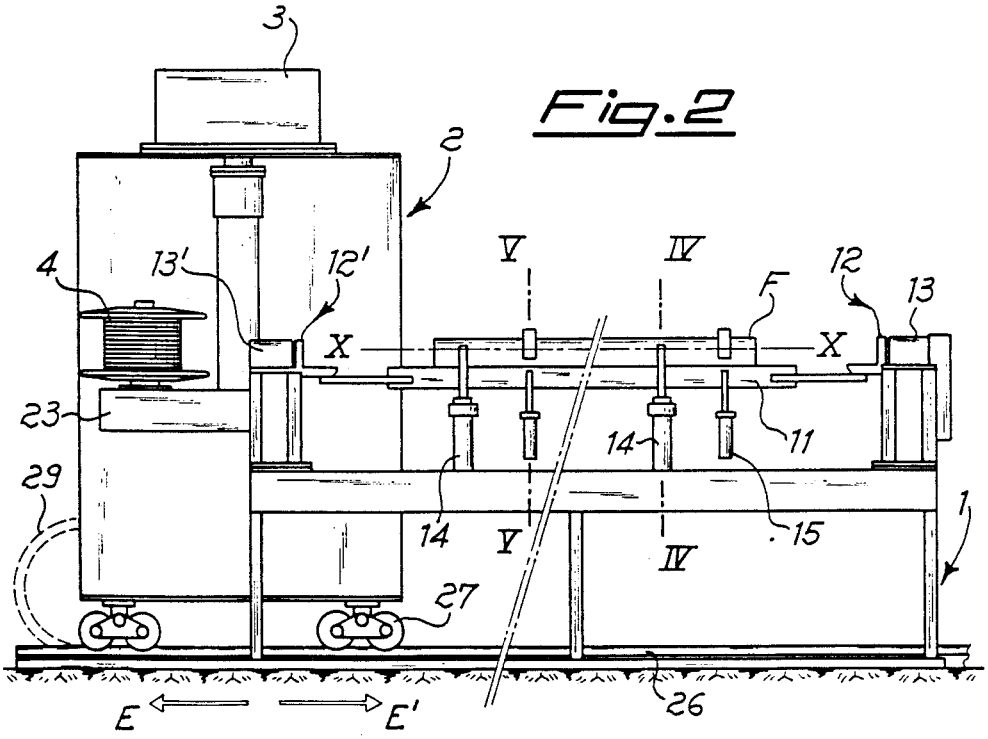
FIG. 2 shows a cut-off schematic view taken at right angle to the direction of FIG. 1.
Figure 3:
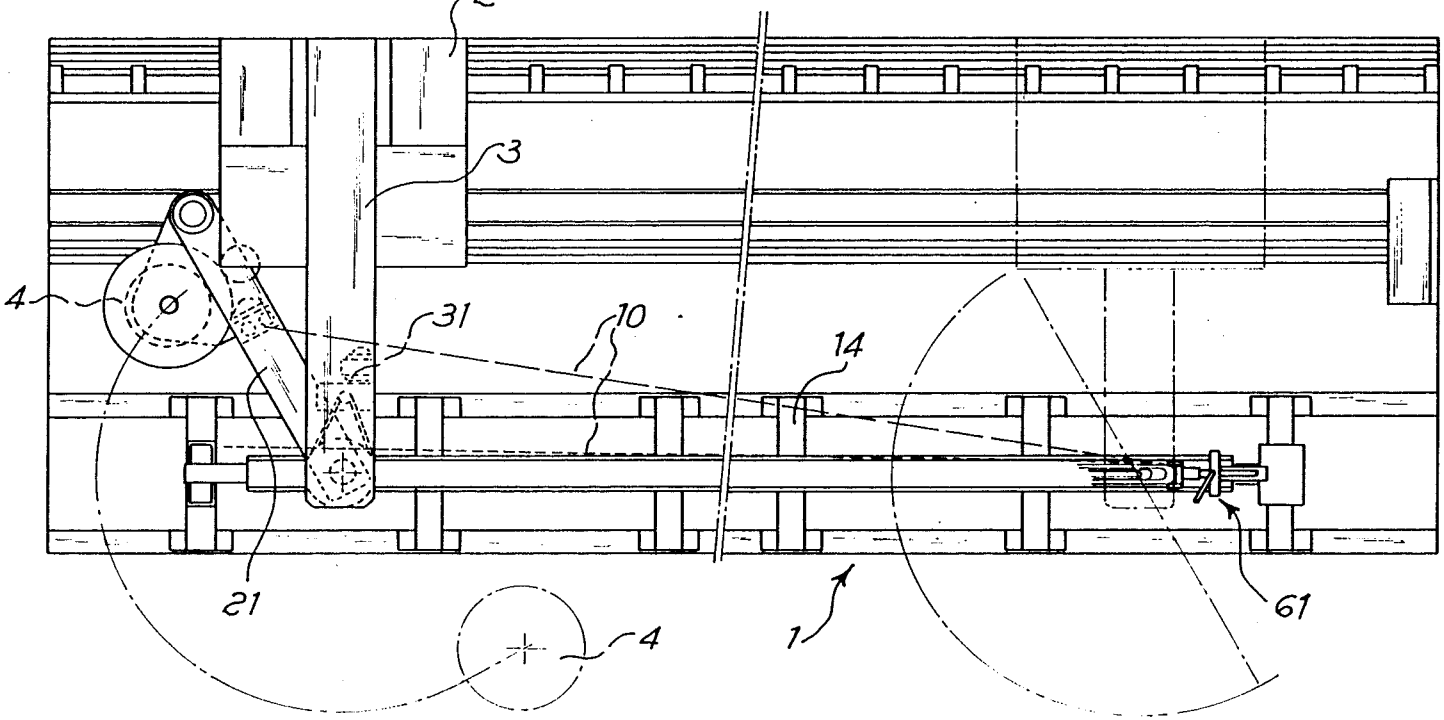
FIG. 3 shows a top plan view, again schematic, of the apparatus according to the invention, illustrating the rotation movement of the feed reel carrying arm.
Figure 4:
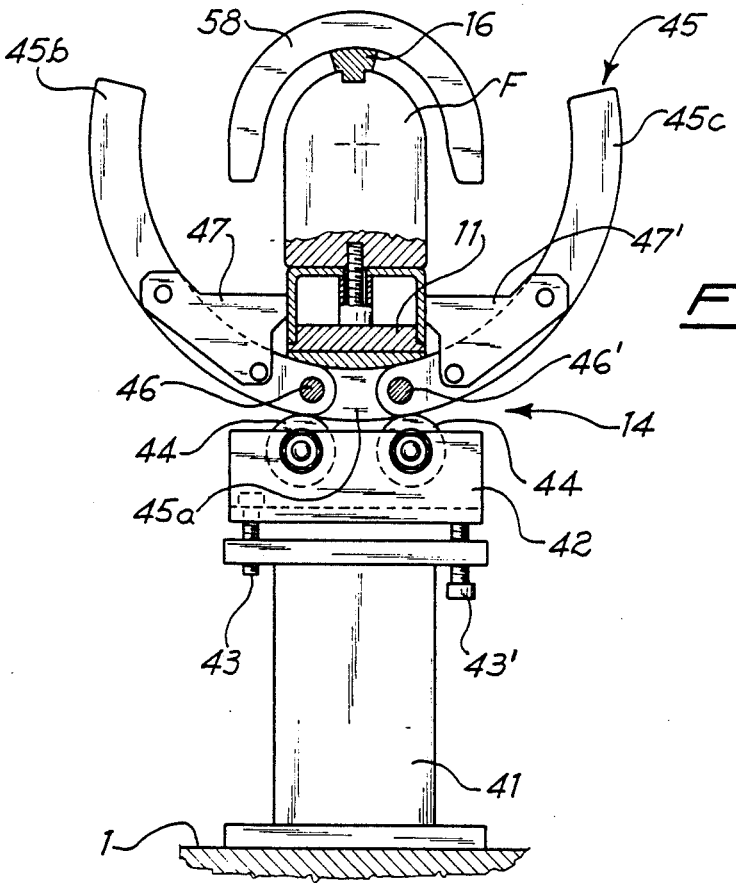
FIG. 4 shows a cross-section view along line IV—IV of FIG. 2 and FIG. 4*a* a detail of FIG. 4 at two different situations of rotation of the winding support holder.
Figure 4A:
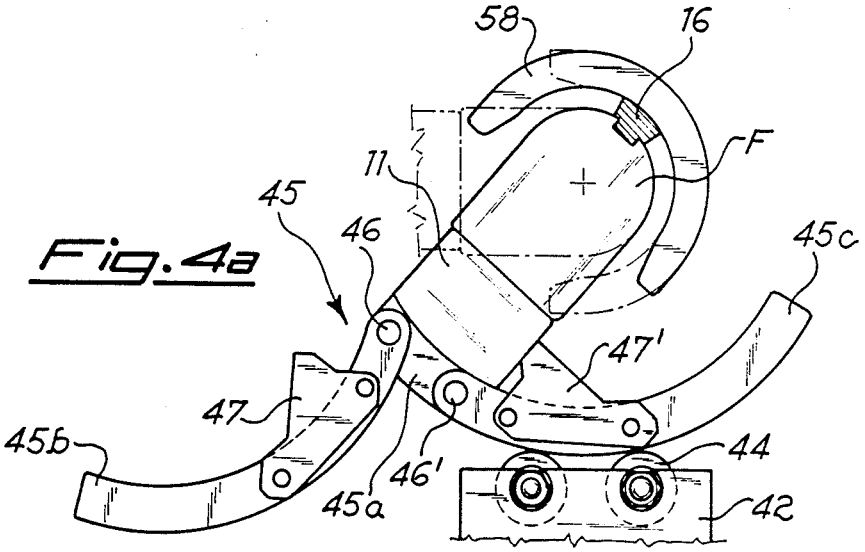

With reference to the drawings and especially to FIGS. 1-3, the apparatus of the invention is basically comprised of two parts, one of which is stationary, substantially a bed 1 of support of a usually metallic form F having a reversed U-shaped cross-section, on which the winding has to be formed. The form or winding holder F is mounted on an elongated support bar 11, being supported at both ends by means of two L-shaped brackets 12, 12' on two bearings, at least one of which, referred to as 13, is motor driven and the other 13', idle. The rotation axis X—X will be coincident with the axis of the form F corresponding to the bending centre of the semi-circular portion of the form or holder. The two L-shaped brackets 12, 12' are therefore useful to transmit movement from axis X—X to the support bar 11. As stated before, the rotation is carried out in both directions, clockwise and counterclockwise, throughout an angle size of about 180°, until the holder takes from time to time a substantially horizontal position as represented by dash-and-dot lines in FIG. 4*a*, successively directing upward one side and then the opposite one for being able to receive the superconductor cable unwound from the reel as will be described later.

Another basic part of the apparatus is a reciprocable carriage 2 according to arrows E, E', mobile along one side of the structure 1 and parallel to the axis X—X direction. A cantilevered bracket 3 thereof overhanging the structure 1 bears, rotatably mounted about a vertical axis Y—Y perpendicular to and co-planar with axis X—X, a rotatory arm 21 to the free end of which is hanging, through an upright tie bar 22, a plate 23 which in turn supports on a rotatable flange 40 a spool or drum 4 for feeding the superconductor. Carriage 2 is driven with a reciprocating movement by an electric d.c. motor (not shown) mounted inside thereof and having a shaft with a pinion 24 fixed thereto which meshes with a stationary rack 25 parallel to a pair of rails 26, 26' on which pairs of wheels 27, 27' are caused to roll. There is also provided a dust preventing self-cleaning system of known type and an obstacle to tilting, such as formed of a row of rollers 28, slidable from below against an upper guide 28', thereby determining a counter-overturning torque with the forces applied by wheels 27 onto rail 26. A cable carrier chain 29 supplies with electric power the carriage driving motor and all the other motors mounted on the carriage, in particular on the reel bearing arm, as well as an electric closethoused on the same carriage and containing the controls interface logic (with a panel of display to the outside, etc.), and additionally the cables feeding the electro-valves for actuation of the pushers or rams and also reaching the motor (not shown) for driving 13 for the necessary consents.

Referring in particular to FIGS. 1 and 3 it is easy to observe that, as the rotation axis Y—Y of arm 21 is coincident with the vertical plane through rotation axis X—X of holder F, the reel 4 can take positions being more or less symmetrical at either sides of the bed structure 1, upon rotation of about 180° when a preset limit switch has been reached along the path of carriage 2 according to the length of the coil to be formed, while approaching infront of respectively one side and the opposite one of the holder the superconductor 10 which has been unwound from the reel 4 and kept correctly taut by a reverse-current fed motor that constantly opposes to cable 10 unwinding. The motor (not shown) operating rotation of the bar 11 and thereby of the holder F is therefore synchronized, in a programmable mutual interpolation, susceptible of interventions through the control system on carriage 2 by means of control signals transmitted by the operator, possibly by radio, as it is known and however can be performed by those skilled in digital programming, with the carriage 2 operating motor and the motor 31 controlling the arm 21 rotation.

With reference to FIG. 2 it is seen that the support bar 11 is supported not only at the ends thereof, but also by a number of intermediate mountings, preferably equally spaced apart along its length, each of them being generally indicated by the numeral reference 14. Their function is that of guiding the bar 11 and consequently the holder or form F during its rotation, to prevent bendings or warpings thereof, of more or less resilient character which would be otherwise unvoidable owing to the weight and slenderness of form F, so as to reduce as much as possible the free span between two adjacent mountings or supports. These supports 14 are substantially formed, as better shown in FIG. 4, of an upright 41 fixed to the stationary bed 1 and bearing a plate 42 whose position may be adjusted by means of screws 43, 43'. To the plate 42 are rotatably mounted a pair of rollers 44 for rotation about axes parallel to the axis X—X, having their periphery in rolling engagement with a half-ring 45 of solid, hardened iron, connected to the support bar 11 at two points 46, 46', with the periphery thereof engaging rollers 44 being shaped as an arc of circle having its curvature centre on axis X—X. In order that the supports 45 will not tamper with fitting of cable 10 while form F is rotated with one side thereof upward to receive thereon the superconductor, these supports are made swinging, as more clearly shown in FIG. 4*a*. In fact they are comprised of a short central member 45*a*, integral with the support bar 11 and two side wings 45*b* 45*c*, of longer extension, such as to provide engagement with rollers 44 even with holder or form F completely rotated to a horizontal position, which are respectively pivotedly mounted in 46, 46'. Thus upon rotation of holder F, as soon as one of the side wings is disengaged from at least one of two rollers 44, namely the wing at the side moving upward during rotation, it will drop by gravity swinging about the associate pivot pin 46, 46', as indicated e.g. in FIG. 4*a* for the left-hand wing 45*b* in correspondence with a clockwise or right-hand directed rotation of the holder F. To avoid an abrupt downward movement of the swinging support, there can be laterally provided upright rests along which the side wing gradually slides down before a complete drop. Lateral stops 47, 47' have been also represented which are formed of shaped plates fixed to the wings, respectively 45*b*, 45*c*, and have the function of ensuring the assembly stiffness, necessary for the temporary supporting wing, such as 45*c* in FIG. 4*a*, to avoid that the latter collapses and does not keep the required configuration for a correct support.

According to a feature of the present invention at each side of the support bar 11 there are also provided pairs of ram devices 15, preferably interposed between the intermediate mountings 14, each pairs of rams being mounted on a cross plate, transverse to the support bar, preferably in adjustable manner, so uas to vary its distance from the median axis of the form, and consequently from the periphery of the latter. As shown in FIG. 5, to the bottom of a structural member 53 being integral with the bar 11, two plates 52, 52' are fixed by a screw 54 passing through a slot 55 thereof, so as to render adjustable the length by which they protrude to the outside. The two plates are aligned each other in a plane transverse to the median plane of the holder F passing through axis X—X, and have mounted at their outer end a pneumatic cylinder 56 whose piston 56*a* bears a flexible blade 57, such as of spring steel,-possibly a double blade, at the free end of which a block 57*a* is fixed, preferably of a high mechanical resistance resin such as "Delrin", having a pushing action onto the superconductor cable brought near to the form F, as well as a blocking action for the position of the already wound coil turns, as shown in two successive steps of its operation at FIGS. 5*a*, 5*b*. With reference to these two figures, the action of each pusher is assisted and caused to be feasible by a shaped matching member 58, preferably of a "Delrin"-type material the inner profile of which, substantially U-shaped, is homologous to the form F profile to which it is initially fixed, such as by screwing, at predetermined locations, to a central spacer member 16 extending along the whole winding-holder form and defining the separation between opposite sides of the interest turn, suitable also to serve as a backing anvil to the action of pusher 57 as it is seen in FIG. 5*b*. From this figure is also clear how the pusher, due to its flexibility, slips between the form F and the curve matching member 58 being able to follow the profile thereof up to complete its stroke as soon as the lengths of superconductor 10 already fitted on that side, including the last one pushed from the position of FIG. 5*a*, are all pressed close against the spacer 16.

The path of the ram means, thereby the positioning of the associate cylinders 56 is as tangential as possible to the form F and, to avoid any interference during the initial portion of this path, before engaging the respective element 58, there are preferably provided tubular guide and protection members 59. To ensure the above-mentioned tangential position, it is possible to adjust the plates 52, 52' with respect to the support central body 53. In particular the right-hand side of FIG. 5 shows the cylinder 56' brought to the outside in correspondence with the formation of a second layer winding. As a matter of fact, in the case of two layers-dipoles, when the first layer has been completely wound and all the necessary operations for its consolidation have been carried out, which however are not a part of the present invention, the preparation of the second layer begins by applying onto the first, at each pair of cylinders 56, 56', another matching and housing element 58' of suitable profile and at the same time the two pusher support plates 52, 52' will be moved outwardly. To render easier this operation, whenever the thickness required for the first layer is known in a standard production of coils of this type, there will be already provided two fixed positions of plates 52, 52', one of which corresponds to the first layer and the other to the second.

With reference to FIGS. 6, 6*a* it will be appreciated that mobile pressure devices 61 are provided also at the ends of the coil to be formed in order to enhance the plastic deformation of the superconductor and its adaptation in the area correspond to the ends of the wound turns (see FIG. 6*b*) while the reel moves along the rectilinear path length of cable stretching. For this purpose, at each end of the form F a pressure device 61 is provided, which is formed of a cylinder-piston 62 mounted on a mobile support quickly applicable to the structure 1. In particular, the quick fastening is accomplished by means of two side clamps 66, 66' which are put astride of the form F being clasped under the support bar 11, in proximity of the bracket 12 by means of an eccentric wheel 67 driven by a lever 68. The eccentric engages a movable member 69 against a return spring 69*a* and pushes the same to a blocking position of the clamps.

Cylinder 62 is fed by suitable means, such as the oil-pneumatic pump, not shown, controlled by the operator. The associated piston 62*a* is joined with a plate 63 provided with a shaped finger 64 adapted to push the formed coil end against the spacers 17 which define the cable bending, in particular of the already wound outer end thereof. There is also provided over the piston 62*a* a guide pin 65 to prevent the assembly from undesired movements. and to keep the whole device at such a position that the action of the piston is actually directed axially.

Figure 7:
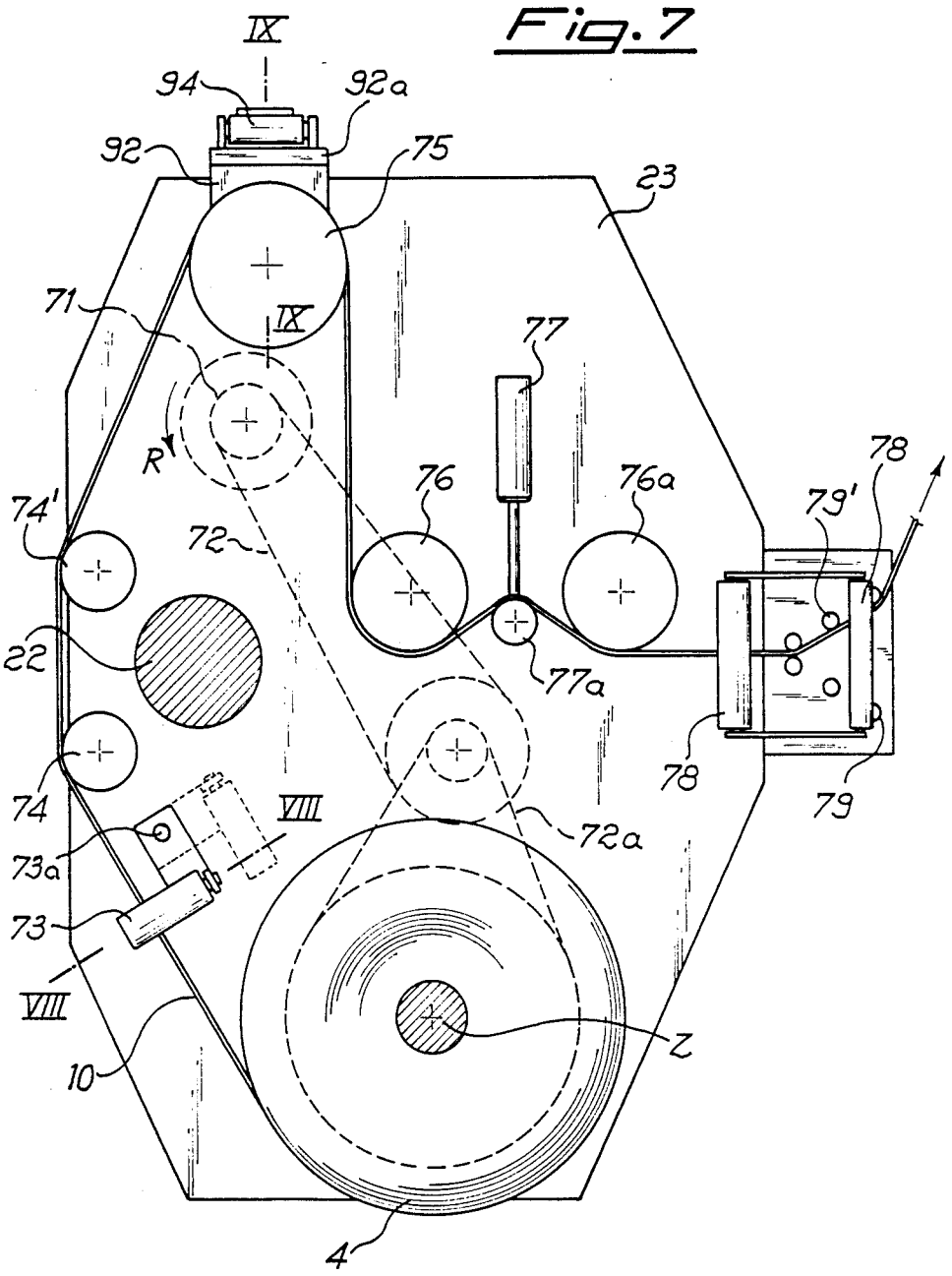
FIG. 7 shows a schematic, top plan view of a support plate mounting the feed drum carried by the rotating arm.
Figure 9:
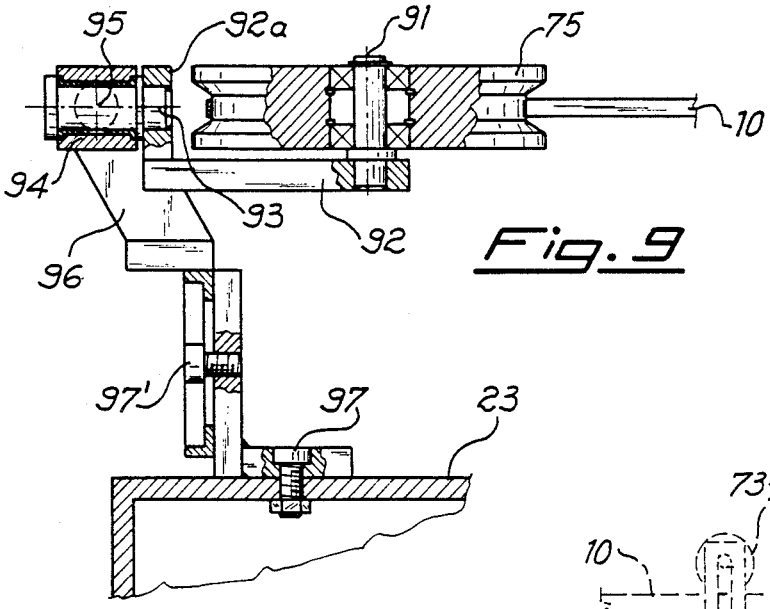
Figure 8:
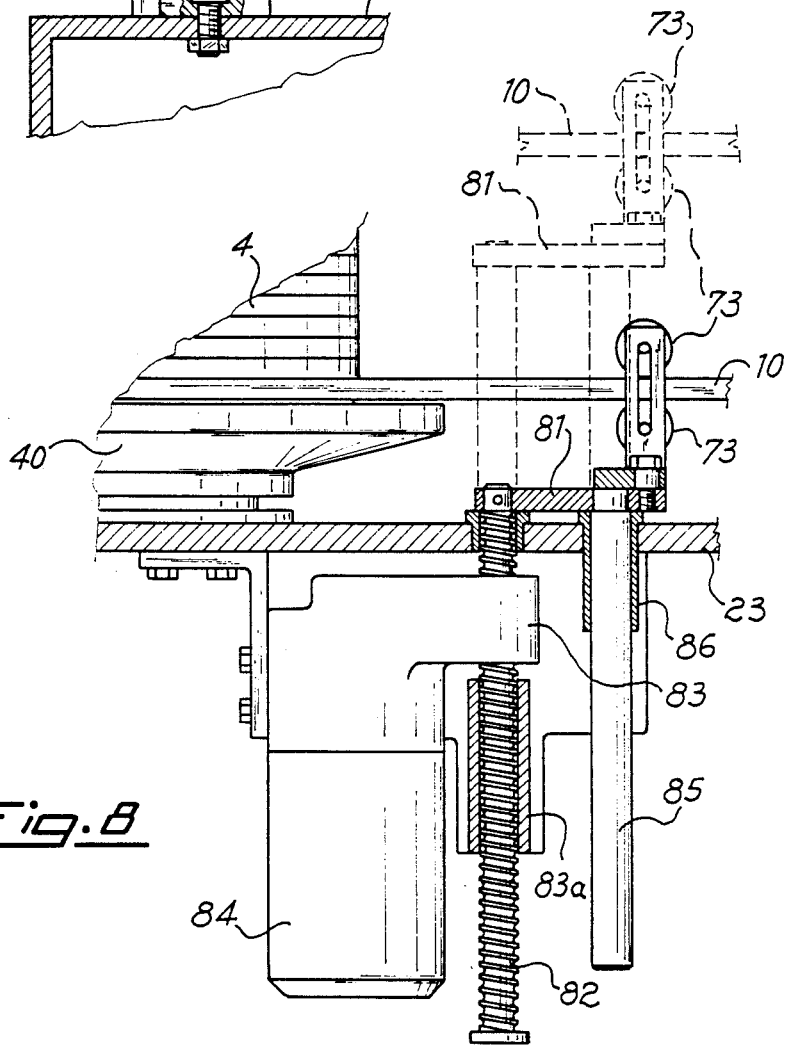
FIG. 8 shows in greater detail a cross-section along line VIII—VIII of FIG. 7; an FIG. 9 shows, still in greater detail and cross-sectioned along a plane perpendicular to the FIG. 7 plane another particular thereof.

Referring now to FIGS. 7, 8 and 9 there is illustrated in grater detail the mechanism which operates the unwinding of cable 10 from the feed reel 4 and in particular, according to the invention, superconductor rewinding means back onto the reel itself. The support plate 23, connected to the rotatable arm 21 through the upright bar 22, bears at its lower side a d.c. motor 71 the outlet of which is connected, e.g. by means of pulleys and toothed belts 72, 72*a*, to the motor shaft Z, passing throughout the plate 23, of a support flange (see FIG. 1) of reel 4, which is mounted thereon by a known quick coupling, easy to be fastened and released. The conductor cable 10, unwound from reel 4, before leaving the plate 23, follows a relatively long path passing first (but only in case of rewinding, as will be explained later) between a pair of rollers 73 whose height with respect to the plate 23 is variable as it will be explained with reference to FIG. 8. Cable 10 then passes about guide pulleys 74, 74', an additional pulley 75 capable of oscillating about a diametral plane thereof, as will be better explained with reference to FIG. 9, and finally, before exiting across a row of rollers 78, 79, is partially wound about a pair of transmission pulleys 76, 76*a* between which a roller 77*a* of a stretch detector 77 is placed, suitable to control the rewinding device described later on. At the outlet, in addition to two elongated rollers 78, being transverse to the path of cable 10 of which they define the height, there are provided two rollers trains 79, 79' diverging from each other and suitable to guide the cable 10 without abrupt deviations, along one or the other direction according to the unwinding direction.

With reference to FIG. 8, the pair of rollers 73 being one above the other and mutually spaced of a distance, possibly adjustable, equal to the cable 10 height, are mounted on a support plate 81 of variable spacing from plate 23. Plate 81 is integral with or fixed to the head of a screw 82 engaging by circulating balls a stationary nut-screw or scroll 83 which is operated by a d.c. or step-by-step electric motor 84 mounted to the lower side of plate 23. The lower position of screw 82 corresponds, as represented in FIG. 8 by a continuous line, to rollers 73 being aligned with the lower exit level of the cable 10 from reel 4, flush with the lower base 40. The vertical stroke of screw 82, thereby of rollers 73, will be such as to correspond to the height difference between the two limit positions of cable 10 leaving the reel 4, i.e. the distance between its upper and lower base. In FIG. 8 the upper end-of-stroke position of the pair of rollers 73 has been illustrated in phantom. In order to better guide the movement of the support plate 81, a guide pin 85 is preferably provided, parallel to the nut-screw guide 83 and, at least for a length, slidable in a guide collar 86 integral with or fixed to plate 23, extending for some length thereunder. Motor 84 will be preferably controlled by the stretch responsive device 77 whereby, in case of cable rewinding, either partially for taking up the cable immediately after the rotation of the reel-holder arm when actuated, or during a given length of possible fresh rewinding, the lack of stretch sensed in 77, before motor 71 automatically rewinds the cable by taking up the excess length thereof, will cause motor 84 to start for the reciprocating movement in vertical direction of the pair of rollers 73, thus ensuring a correct rewinding onto the reel 4. During normal operation rollers 73 do not tamper with the cable 10 path, as they are e.g. rotated about a pin 73*a* to the position represented with broken lines (FIG. 7).

Finally to avoid, at wichever operating condition, an abrupt deviation of cable 10 from a level possibly being the upper one as shown by broken lines in FIG. 8 to the exit level corresponding to rollers 78, 79, substantially coincident with the plane of plate 23, the pulley 75 is positioned at an intermediate level being mounted, as shown in FIG. 9, with its axis 91 rotatable on a plate 92, e.g. L-shaped, a leg 92*a* of which can rotate about an axis 93 perpendicular to said axis 91 and substantially co-planar with the diametral plane or winding throat of pulley 75. The axis 93 is in turn rotatable within an arm 94 about an axis 95 which is at right angles with axis 93 and co-planar therewith, still in the same plane defined by the throat of pulley 75. The said arm 94 is mounted on a bracket 96 which is adjustable as to height and generally to be fixed at a position chosen on the plate 23 by means of adjusting screws 97, 97'. Therefore pulley 75 can swing as freely as possible about two independent axes the position of which can also be adjusted. Thereby the path of cable 10 can assume, in correspondence with this pulley, the most suitable pattern to avoid uneven deflections from the rollers upstream of the pulley and those downstream thereof.

It will be appreciated that, although not described in detail, the apparatus has a plurality of accessory and auxiliary equipments, required for its automatic operation, which however are not comprised in the object of the invention, essentially relating to the mechanical apparatus which renders these automatisms feasible. In particular end-of-stroke or safety microswitches are provided on the carriage, which can be preset according to the path length to be followed by the carriage to and from each time in order to determine the cable length to be unwound, corresponding to one side of each coil turn, combined with the programmed controlling the synchronization of the various movements. Suitable limit microswitches are also mounted on the reel-holder rotating arm, in particular around plate 23 to avoid the consequences of casual impacts, in which case the apparatus immediately stops and the programmed is interrupted.

Still with reference to the manufacturing of coils for dipole magnets (in case of quadrupoles the operation is identical, the only difference being that each winding would extend itself along a 90° arc, instead of 180° ), as it is clear from the foregoing description, the apparatus operation is the following. The correct programmed having been set as to the number of turns, their length and bending radius of their ends, and the tangential rams having been adjusted at the position corresponding to the first layer, the superconductor 10 end is clamped onto the winding holder-form F by whichever known means, such as a self-locking clamp, and upon having chosen the pull force through the electronic regulation of motor 71 which is caused to rotate to the direction of arrow R of FIG. 7, the apparatus is started and the carriage begins its first forward stroke, while motor 13 has rotated the bar 11 and form F until the latter reaches a substantially horizontal position so as to show, facing upward, the side along which the first side of the first turn has to be laid. As seen above at this position the swinging supports 45 are all lowered from the same side which therefore is left clear for the subsequent approaching of the cable which until the end of stroke of the carriage 2 disposes itself by taking an angled position as shown in FIG. 3, starting from the fixed point on the form up to the point of outlet from the reel, more precisely from the roller trains 79, 79'. It should be observed that the initial anchoring point of the cable can be located at choice at the motorized end or at the driven end of the form: in any case the movement of carriage 2 causes unwinding of the cable 10 against the force exerted by motor 71 having the tendency to rewind the cable as stated above, thus giving rise to a predetermined pull. At the end of the programmed stroke of carriage 2, through the possible safety control provided by the limit microswitch, the CPU controls operation of the rotating arm 21 through the rotation of geared motor 31. The arm 21 carries out a rotation of about 180°, as represented in FIG. 3, but at the same time the motor connected to 13 is actuated to rotate the form F about 180° C. for facing upward its opposite side, thus being prepared to receive on this side the elongated length of superconductor. However in the meantime as a consequence of a synchronized control signal, all the rams 15 which are at the side already accommodating the superconductor 10 have triggered at the same time, to keep it in position against the central spacer 16 serving as a shoulder, thus preventing the same from loosing or leaving such a position during the form rotation to an opposite direction. While the reel rotates at an end of the coil to be formed, the cable is positioned around a shaped block 17 (FIG. 6*b*) properly arranged so as the cable, while rotating thereabout, will follow the desired pattern for the first turn with the required bending radius. Immediately thereafter, by means of a quick manual application, the axially acting pressure device 61 will make its intervention (FIGS. 6, 6*a*), having been schematically shown in FIG. 3 at only one of the form ends. Upon such a rotation of arm 21 the carriage 2 will resume its movement by reversing its path direction with contemporary unwinding, as stated before, of cable 10 which now is anchored at the end opposed to the one of winding start. In the meantime the rams or pushers continue to keep the first-laid side of turn against the spacer 16 and now, when the second stroke of carriage 2 is over, also the rams of this side operate to accommodate and fasten the superconductor on the upwardly directed side of the form, while the swinging semi-circular supports are in a lowered position from this side to allow the cable to pass. The operation then is repeated as many times as the number of turns required by each layer, taking into account that the rams 15 are substantially always projecting forward in a locking position to keep the previously formed coil turns motionless, only excepted the moment at which the carriage 2 is near to reach a programmable preset location of its path, when the reel-holder arm is going to start its rotation, because then the pushers being on the side adjacent to the reel passage just over when this form side is still facing upward, all at the same time are retracted to allow fitting of the cable, as shown in FIG. 5*a*, and thereafter immediately are locked to keep it positioned against the previously laid turns, as shown in FIG. 5*b*. At this stage the motor 13 and rotate the form to face the opposite side upward without any danger that the winding portion already arranged may be loosen or even drop. Obviously if the winding ends have a shape with differentiated bending centres, as shown in FIG. 6*b*, the operator shall intervene only for inserting shaped blocks or additional spacers 17', 17'' which are necessary upon development of the turns toward the periphery of the coil, whereas the consequent variations in the length of the carriage stroke and in the superconductor cable length, to be taken up for maintaining the same preselected pull forces also during the arm rotation, are automatically determined thanks to the preset programmes including all the coordinate parameters relating to the final shape of the coil, possibly providing reversed directions of the turn winding. As stated before the pressing plate of the two end pressure devices 61 will be each time replaced by different shapes.

Upon completion of the first layer of the coil, no changement is had as to the second layer which is gradually formed onto the first one, already compacted or "polimerized", like this had been formed in turn on the form/holder F. The relevant parameters will have only to be modified in relation with the three basic motions, the positions of the tangential rams 15 will have to be adjusted and the matching, housing and guide profile 58 will have to be adjusted.

It should be finally appreciated that each one of the above-mentioned movements and operations, although described advantageously as automatic, may be carried out also manually, in which case the controlling programmed will be excluded.

Possible additions and/or modifications could be performed by those skilled in the art to the above described and illustrated embodiment of the apparatus according to the invention without exceeding the scope of the invention itself. In particular intermediate support means could be provided, different from the illustrated means and in general, still remaining in the inventive scope, mechanically equivalent device and operations could be adopted, having an effect comparable with those illustrated.

What I claim is:

1. An automatic apparatus for obtaining windings of a superconductor cable on a form in the manufacture of coils particularly suitable for dipole or quadrupole magnets, comprising a structure adapted to rotatably bear a bar for supporting said form, there being provided means for rotating said bar and said form fixed thereto about a longitudinal symmetry axis of the winding, the rotation extending alternately in either direction by about 180°, whereby said form at each end of stroke directs upwards respectively one side and the opposite one with respect to a symmetry median plane passing through said axis, there being also provided a multiplicity of intermediate support means at spaced apart locations along said support bar to bear the same and said form at every positioning thereof during their rotation, with the cable being fed by a reel arranged for rotating around said structure symmetrically with respect to said median plane; said apparatus further comprising a carriage arranged for running along a reciprocate path on one side of the structure at a distance therefrom, parallel to said axis, with said reel being supported by a rotatable arm which is mounted for rotation about a second, vertical axis co-planar and perpendicular to said first axis with respect to a cantilevered bracket fixed to said carriage and overhanging said structure, the reel being thereby allowed to reach positions on either sides of said form upon a 180° rotation of said support arm, there being also provided ram means mounted in pairs to said support bar at both sides of the form, the pushing elements of which direct their action tangentially to said form in association with shaped matching and guide profiles, said movement of rotation about said two axes and reciprocating stroke of the carriage being synchronized and interpolated to each other in a programmable manner.

2. The automatic apparatus of claim 1, wherein said reel is rotatably mounted on a support plate being connected to said arm through an upright tie bar and is continuously subjected to a pull action exerted by a motor opposing to the cable unwinding from the reel, said pull action being predetermined and electronically adjustable.

3. The apparatus of claim 2, wherein to said reel support plate there is further mounted a device for correctly distributing the cable to be rewound about said reel, a detecting means being also provided for sensing the stretch level of the cable leaving the reel.

4. The apparatus of claim 3, wherein said device for a correct rewinding comprises a pair of vertically aligned rollers, mounted on a plate whose height distance from the support plate and thereby the reel is variable, as it is fixed to a ball circulating screw which meshes within a nut-screw operable by a linear movement geared motor being controlled by hand operation or by said detector upon decreasing of the cable stretch before said motor has rewound the excess length of cable.

5. The apparatus of claim 3, wherein along the cable path on said support plate downstream of the reel outlet, there is provided at least a deviating pulley after said rollers pair and upstream of said stretch detector, that is arranged to swing about two axes at right angles and co-planar in a plane perpendicular to its rotation axis, substantially corresponding to the throat for cable sliding, said two axes being adjustably supported on said reel support plate.

6. The apparatus of claim 1, wherein said arm rotation is controlled by a geared motor gear mounted on said carriage, to be operated according to the preset programmed and upon reaching a microswitch at an end of stroke of the carriage.

7. The apparatus of claim 6, wherein during the arm rotation about said second axis, every ram means mounted on the bar side which is contiguous to the reel path just completed and to the form side still facing upwards is actuated, all at the same time, first to release for allowing the cable length, longitudinally stretched, to pass and then to lock immediately thereafter for pushing said cable length against the previously laid coil turns and keeping the same at this position.

8. The apparatus of claim 7, wherein each of said rams comprises a pneumatic cylinder fixedly connected to said support bar through a support plate and having a piston rod with a flexible longitudinal portion as a metal blade, provided at the free end with a pushing member capable of fitting between said matching profile and the periphery of said form or the first finished winding layer in case of formation of the second layer, there being further provided a tubular guide and protection element about at least a first path length of said pushing means.

9. The apparatus of claim 8, wherein said support plates can be positioned adjustably by means of a screw in a transverse direction to a median plane of the form for tangentially positioning said ram means in association with the first or respectively second layer of the coil.

10. The apparatus of claim 1, wherein each pair of tangentially acting ram means is interposed between one of said intermediate support and the subsequent one.

11. The apparatus of claim 1, further comprising at each end an axial pressure device for keeping motionless pressed the ends of coil turns previously formed.

12. The apparatus of claim 11, wherein said device comprises a cylinder-piston which can be mounted manually by a quick coupling to the support bar by means of side clamps to be tightened by an eccentric upon a lever actuation, there being provided return springs.

* * * * *